US006890150B2

(12) United States Patent
Tomberg

(10) Patent No.: US 6,890,150 B2
(45) Date of Patent: May 10, 2005

(54) CENTER-LOCATED CUTTER TEETH ON SHROUDED TURBINE BLADES

(75) Inventor: Steven Eric Tomberg, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/638,302

(22) Filed: Aug. 12, 2003

(65) Prior Publication Data

US 2005/0036886 A1 Feb. 17, 2005

(51) Int. Cl.[7] ..... F01D 11/08
(52) U.S. Cl. ..... 415/173.4; 277/415
(58) Field of Search ..... 415/173.4, 172 A, 415/172 R, 174, 170 R, 115–116, 47–48, 415/12, 173, 1–5; 277/415; 51/295

(56) References Cited

U.S. PATENT DOCUMENTS

| | | | | |
|---|---|---|---|---|
| 4,053,111 A | | 10/1977 | Eminger | |
| 4,227,703 A | * | 10/1980 | Stalker et al. | 277/415 |
| 4,961,310 A | | 10/1990 | Moore et al. | |
| 5,064,343 A | * | 11/1991 | Mills | 415/173.3 |
| 5,197,281 A | | 3/1993 | Przytulski et al. | |
| 5,407,320 A | * | 4/1995 | Hutchinson | 415/116 |
| 5,452,529 A | | 9/1995 | Neuenfeldt et al. | |
| 5,833,244 A | * | 11/1998 | Salt et al. | 277/421 |
| 5,899,660 A | * | 5/1999 | Dodd | 415/9 |
| 6,086,328 A | | 7/2000 | Lee | |
| 6,171,351 B1 | * | 1/2001 | Schroder et al. | 51/295 |
| 6,241,471 B1 | | 6/2001 | Herron | |
| 6,254,345 B1 | | 7/2001 | Harris et al. | |
| 6,302,651 B1 | | 10/2001 | Kildea et al. | |
| 6,409,471 B1 | | 6/2002 | Stow | |
| 6,457,939 B2 | * | 10/2002 | Ghasripoor et al. | 415/174.4 |
| 6,478,304 B1 | * | 11/2002 | Hoffelner | 277/415 |
| 6,494,678 B1 | | 12/2002 | Bunker | |
| 6,506,022 B2 | | 1/2003 | Bunker | |
| 6,533,285 B2 | * | 3/2003 | Nava et al. | 277/415 |

OTHER PUBLICATIONS

U.S. Appl. No. 10/460,205, filed Jun. 13, 2003, Tomberg et al.
U.S. Appl. No. 10/639,473, filed Aug. 13, 2003 Tomberg et al.

* cited by examiner

*Primary Examiner*—Edward K. Look
*Assistant Examiner*—James M. McAleenan
(74) *Attorney, Agent, or Firm*—Nixon & Vanderhye P.C.

(57) ABSTRACT

A turbine bucket includes an airfoil having a tip shroud, a shank and an entry dovetail; a tip shroud seal projecting radially outwardly from the tip shroud and extending continuously between end edges of the tip shroud in a direction of rotation of the airfoil about a turbine axis; a cutter tooth carried by the tip shroud seal for enlarging a groove in an opposing fixed shroud, the cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein the center point is located about ½ inch along the Y-axis from the X=0 position, and wherein the Z-axis is located 0.517 inches from an outside edge of a seal pin extending along said entry dovetail, as measured in a direction normal to the shank of the bucket.

10 Claims, 6 Drawing Sheets

CENTER-LOCATED CUTTER TEETH ON SHROUDED TURBINE BLADES

BACKGROUND OF THE INVENTION

The present invention relates to turbine buckets having airfoil tip shrouds and, particularly, to a shroud for a stage 2 bucket having a tip seal extending between opposite ends of the shroud, with a cutter tooth located along said tip seal, substantially centered between the opposite ends of the shroud in the direction of rotation of the bucket.

Airfoils on turbine buckets are frequently provided with tip shrouds. The shroud prevents failure of the airfoil in high cycle fatigue due to vibratory stresses. A tip shroud seal typically projects radially outwardly from the outermost surface of the shroud, and extends circumferentially between opposite ends of the shroud in the direction of rotation of the turbine rotor. The tip shroud seal conventionally extends radially into a groove formed in a stationary shroud opposing the rotating tip shroud. In some designs, the stationary shroud has a honeycomb pathway. Rather than providing a zero tolerance seal between the tip shroud and the stationary shroud, resulting in instability of the airfoil, it has been found desirable to provide a leakage path over the tip shroud seal which will remove such instability. Typically, a cutter tooth is provided at the leading edge of the tip shroud seal so as to cut a wider groove in the honeycomb pathway of the stationary shroud than the width of the tip shroud seal. This enables leakage flow between the high and low pressure regions on opposite sides of the tip shroud seal within the groove. While this results in an undesirable decrease in pressure drop across the airfoil with resulting diminishment of sealing capability, the lost efficiency is compensated by an increase in the stability of the airfoil.

Because the mass of the tooth is not located in the same radial line as the center of mass of the airfoil, however, it has been discovered that this asymmetrical design increases the stresses in the fillet below the shroud on the bucket (i.e., in the region between the airfoil and the tip shroud) particularly at high temperatures. This increased stress at high temperatures leads to a high creep rate and ultimately can result in failure of the shroud, for example, by cracking or splitting. It will be appreciated that the failure of a single bucket shroud causes the turbine necessarily to be taken off-line. Consequently, shroud failure due to increased stress at the fillet region between the tip shroud and the airfoil requires time-consuming and costly repairs, including bringing the turbine off-line, in addition to the labor and replacement parts necessary to effect the repair.

BRIEF DESCRIPTION OF THE INVENTION

In accordance with an exemplary embodiment of this invention, the cutter tooth on the airfoil tip shroud is located approximately in the center of the shroud but in reference to X, Y and Z axes that are employed to define the shape of the airfoil portion of the bucket. The airfoil portion is further defined in commonly owned co-pending application Ser. No. 10/460,205 entitled "Airfoil Shape For A Turbine Bucket."

More specifically, the bucket airfoil profile is defined by a unique loci of points to achieve the necessary efficiency and loading requirements whereby improved turbine performance is obtained. These unique loci of points define the nominal airfoil profile and are identified by the X, Y and Z Cartesian coordinates as described in the above-identified pending application. The positive X, Y and Z directions are axial toward the exhaust end of the turbine, tangential in the direction of rotor wheel rotation and radially outwardly toward the bucket tip, respectively.

The location of the Z-axis is determined relative to the X and Y axes, using certain surfaces on the bucket shank portion as reference points. In the exemplary embodiment, the Z-axis is located 1.866 inches from a leading edge of the forward bucket tang along the X-axis; and 0.517 inches from an outside edge of a seal pin extending along said entry dovetail, as measured in a direction normal to the shank of the bucket. The Z-axis extends radially outwardly and passes through the tip shroud, and it has been determined that the center of the cutter tooth should be located 0.588 inches along the Y-axis at the X=0 position.

By locating the cutter tooth as described above, stresses are minimized in the tip shroud fillet. The location is approximately in line with the center of gravity of the tip shroud but this is not necessarily a requirement. The reduced stress extends creep life of the fillet which is frequently the life-limiting location of the part.

Thus, in one aspect, the invention relates to a turbine bucket comprising an airfoil having a tip shroud, a shank and an entry dovetail; a tip shroud seal projecting radially outwardly from the tip shroud and extending continuously between end edges of the tip shroud in a direction of rotation of the airfoil about a turbine axis; a cutter tooth carried by the tip shroud seal for enlarging a groove in an opposing fixed shroud, the cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein the center point is located about ½ inch along the Y-axis from the X=0 position, and wherein the Z-axis is located 0.517 inches from an outside edge of a seal pin extending along said entry dovetail, as measured in a direction normal to the shank of the bucket.

In another aspect, the invention relates to a turbine bucket comprising an airfoil having a tip shroud, a shank and an entry dovetail; a tip shroud seal projecting radially outwardly from the tip shroud; a cutter tooth carried by the tip shroud for cutting a groove in a radially opposed fixed shroud; the cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein the center point is located about ½ inch along the Y-axis, and wherein the Z-axis is located 1.866 inches from a forward edge of a forward tang on the turbine bucket entry dovetail, as measured along said X-axis.

In another aspect, the invention relates to a turbine bucket comprising an airfoil having a tip shroud, a shank and an entry dovetail; a tip shroud seal projecting radially outwardly from the tip shroud and extending continuously between end edges of the tip shroud in a direction of rotation of the airfoil about a turbine axis; a cutter tooth carried by the tip shroud for enlarging a groove in an opposing fixed shroud; the cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein the center point is located 0.588 in. along the Y-axis; and wherein the Z-axis is located 1.866 inches from a forward edge of a forward tang on the turbine bucket entry dovetail as measured along the X-axis, and 0.517 inches from an outside edge of a seal pin extending along said entry dovetail, as measured in a direction normal to the shank of the bucket.

In still another aspect, the invention relates to a second stage turbine wheel for a gas turbine rotor, the wheel mounting a plurality of buckets, each bucket comprising an airfoil having a tip shroud, a shank and an entry dovetail; a tip shroud seal projecting radially outwardly from the tip shroud and extending continuously between end edges of the tip shroud in a direction of rotation of the airfoil about a longitudinal axis of rotation of the rotor; a cutter tooth carried by the tip shroud seal for enlarging a groove in an opposing fixed shroud, the cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein the center point is located about ½ inch along the Y-axis from the X=0 position and wherein the Z-axis is located 0.517 inches from an outside edge of a seal pin extending along said entry dovetail, as measured in a direction normal to the shank of the bucket.

In still another aspect, the invention relates to a second stage turbine wheel for a gas turbine rotor, said wheel mounting a plurality of buckets, each bucket comprising an airfoil having a tip shroud, a shank and an entry dovetail; a tip shroud seal projecting radially outwardly from the tip shroud and extending continuously between end edges of the tip shroud in a direction of rotation of the airfoil about a longitudinal axis of rotation of the rotor; a cutter tooth carried by the tip shroud seal for enlarging a groove in an opposing fixed shroud, the cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein the center point is located about ½ inch along the Y-axis from the X=0 position and wherein the Z-axis is located 0.517 inches from an outside edge of a seal pin extending along said entry dovetail, as measured in a direction normal to the shank of the bucket.

The invention will now be described in detail in connection with the drawings identified below.

DETAILED DESCRIPTION OF THE INVENTION

Figure 1:
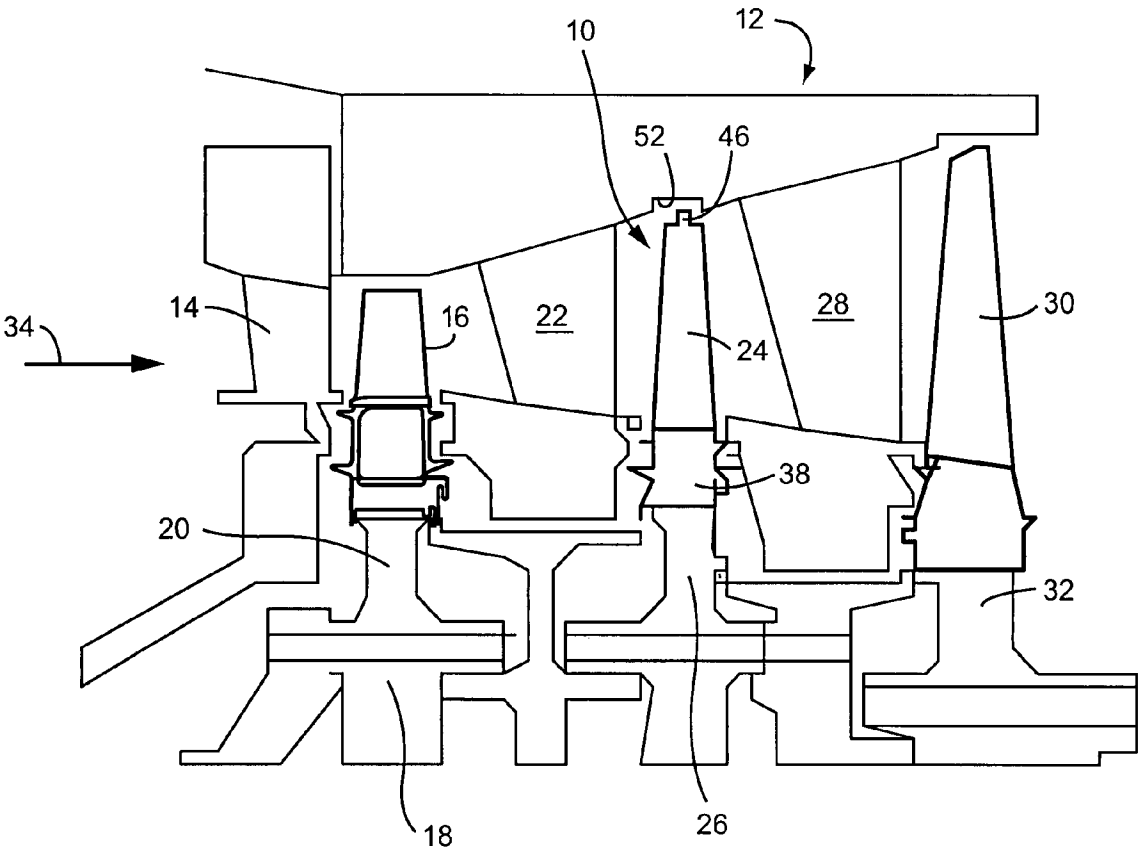
FIG. 1 is a schematic representation of a hot gas path through multiple stages of a gas turbine and illustrates a second stage bucket airfoil according to a preferred embodiment of the present invention.

Referring now to the drawings, particularly to FIG. 1, there is illustrated a hot gas path, generally designated 10, of a three-stage gas turbine 12. The first stage comprises a plurality of circumferentially spaced nozzles 14 and buckets 16. The nozzles are circumferentially spaced one from the other and fixed about the longitudinal center axis of the rotor. The first stage buckets 16 are mounted on the turbine rotor 18 via a rotor wheel 20. The second stage of the turbine 12 includes a plurality of circumferentially spaced nozzles 22 and a plurality of circumferentially spaced buckets 24, also mounted on the rotor 18, via rotor wheel 26. The third stage includes a plurality of circumferentially spaced nozzles 28 and buckets 30 mounted on rotor 18 via wheel 32. It will be appreciated that the nozzles and buckets lie directly in the hot gas path 10 of the turbine, the direction of flow of the hot gas through the hot gas path 10 indicated by the arrow 34.

Figure 2:
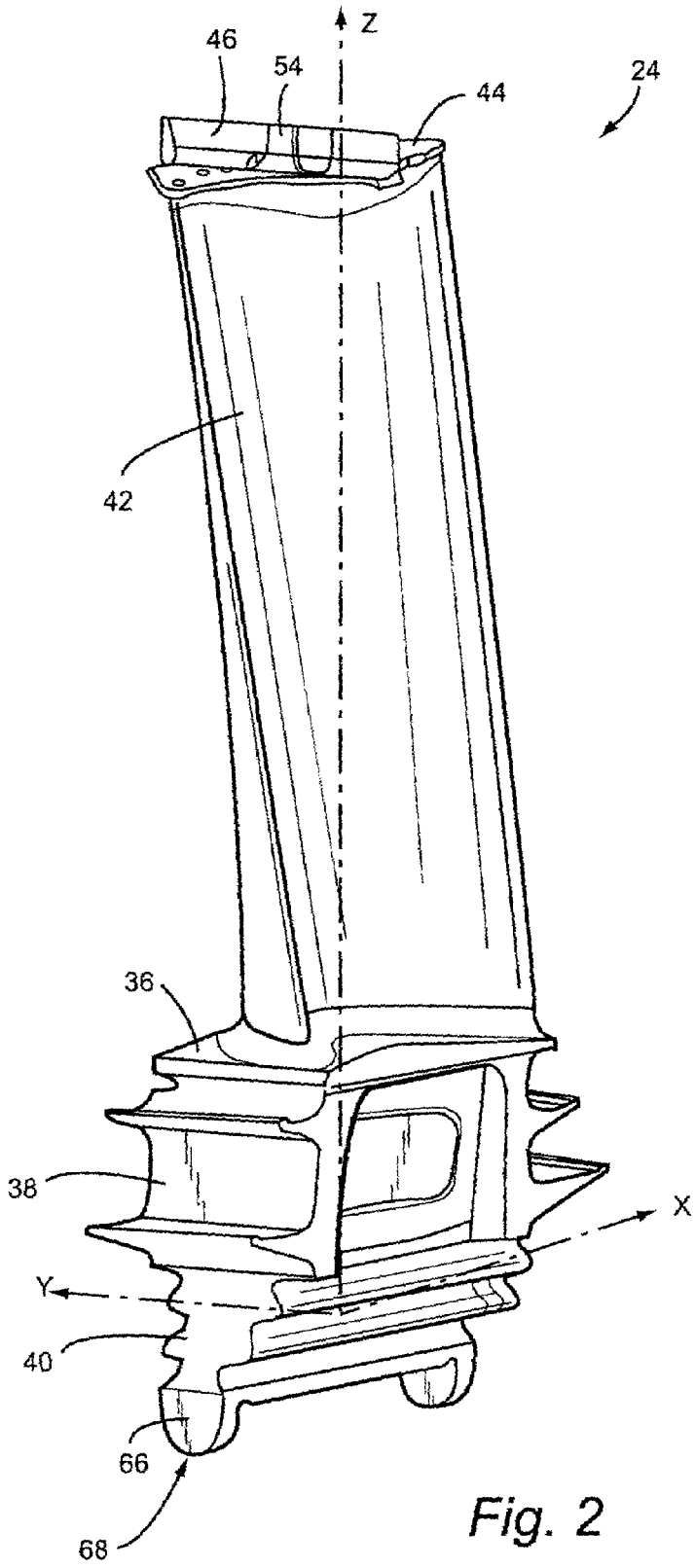
FIG. 2 is a perspective view of a second stage bucket in accordance with an exemplary embodiment of the invention.
Figure 3:
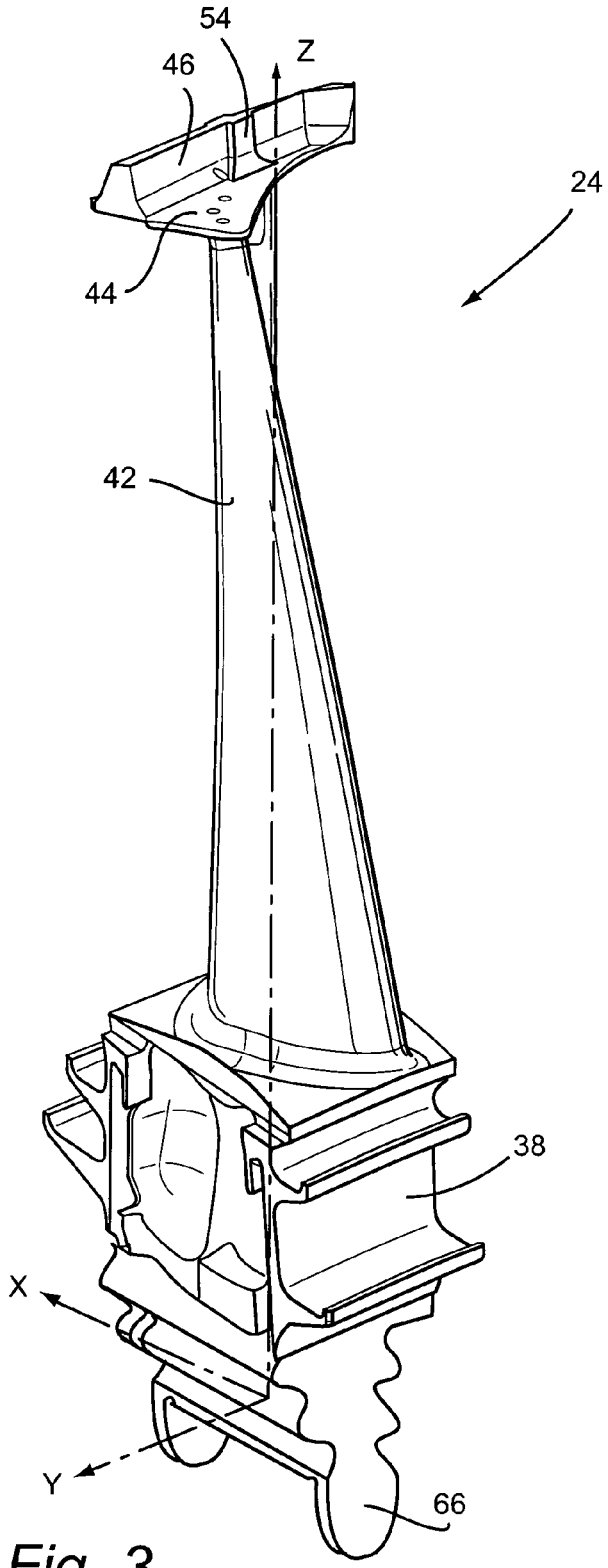
FIG. 3 is a perspective view of the bucket similar to that shown in FIG. 2 but rotated ninety degrees in a counterclockwise direction.
Figure 6:
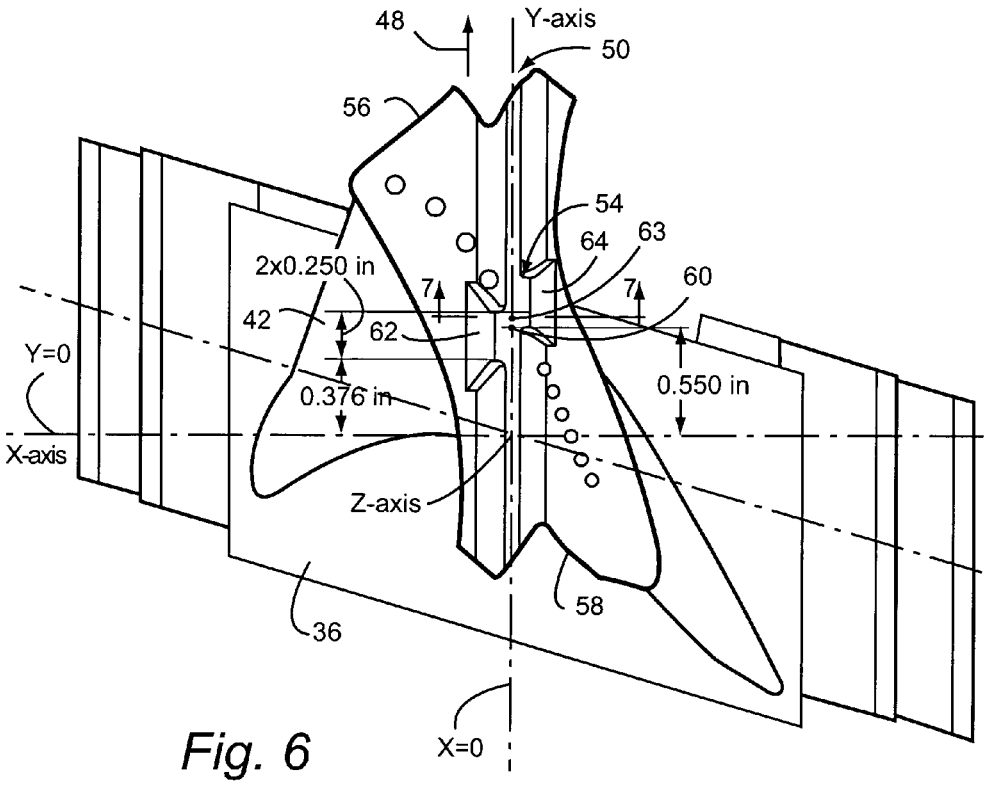
FIG. 6 is a top plan view of the bucket shown in FIGS. 1 and 2.

This invention relates particularly to the buckets 24 of the second stage of the turbine. With reference also to FIGS. 2 and 3, each bucket 24 is provided with a platform 36, a shank 38 and substantially or near axial entry dovetail 40 for connection with a complementary-shaped mating dovetail, not shown, on the rotor wheel 26. An axial entry dovetail, however, may be provided with the airfoil profile of this invention. It will also be appreciated that each bucket 24 also has an airfoil or airfoil portion 42 with a tip shroud 44 at the radially outer tip of the airfoil portion. The tip shroud 44 is formed with an elongated radially projecting tip shroud seal 46 that extends between opposite ends of the tip shroud, in a circumferential direction, i.e., in the direction of rotation of the bucket. It will be appreciated that adjacent shrouds are not connected one to the other. Rather, adjacent shrouds bear against one another in their registering end configurations 50, best seen in FIG. 6. The direction of rotation of the airfoil 42 and bucket of which it forms a part is indicated by the arrow 48, also in FIG. 6.

The tip shroud seal 46 on the rotating bucket is adapted for sealing in a stationary groove 52 formed in an adjacent stationary shroud (FIG. 1). Typically, the stationary shroud includes a honeycomb structure (not shown) within the groove 52 formed with a pathway for the tip seal 46. Consequently, the tip shroud seal 46 produces, in use, a differential pressure on opposite sides of the airfoil portion 42 of the bucket.

Referring again to FIGS. 2 and 3, the tip shroud seal 46 and the configuration generally of the tip shroud 44 are formed similarly as in the prior art. In accordance with an exemplary embodiment of this invention, however, the cutter tooth 54 lies along the tip shroud seal, generally intermediate the opposite ends 56, 58 of the tip shroud, and preferably substantially at the center of the tip shroud in both the circumferential and axial directions. As illustrated, the cutter tooth 54 radially overlies a central portion of the airfoil portion 42.

Figure 4:
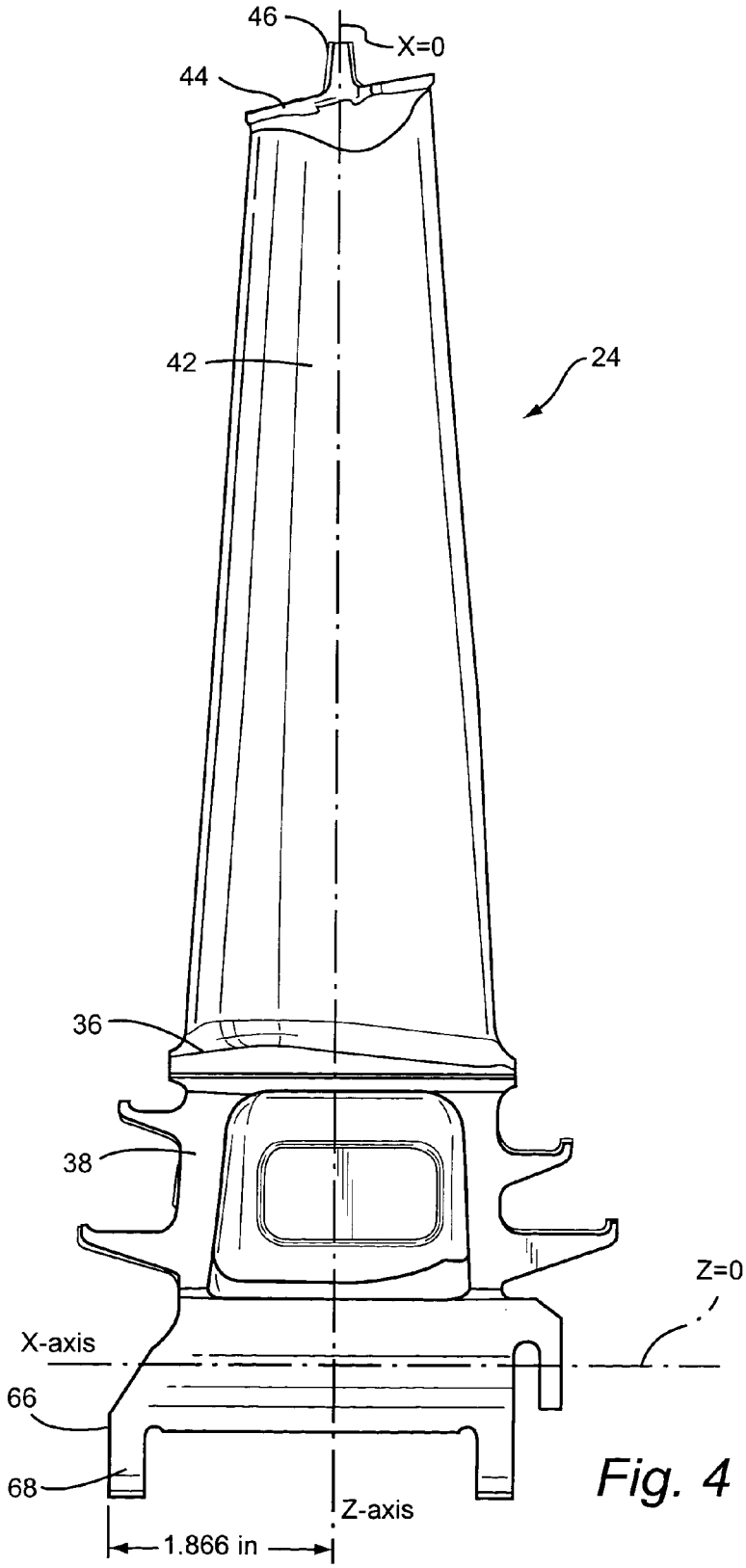
FIG. 4 is a side elevation of the bucket shown in FIG. 1.
Figure 5:
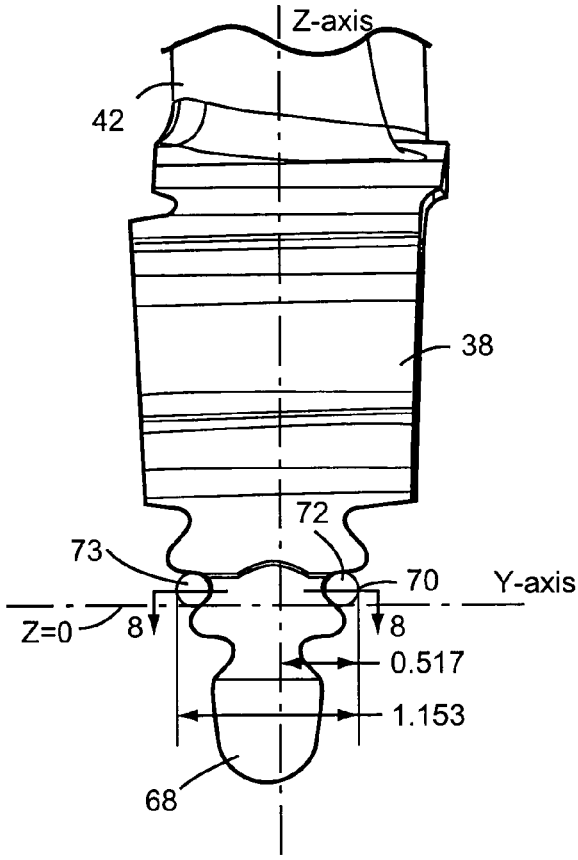
FIG. 5 is a partial enlarged front elevation of the bucket as shown in FIG. 1.
Figure 8:
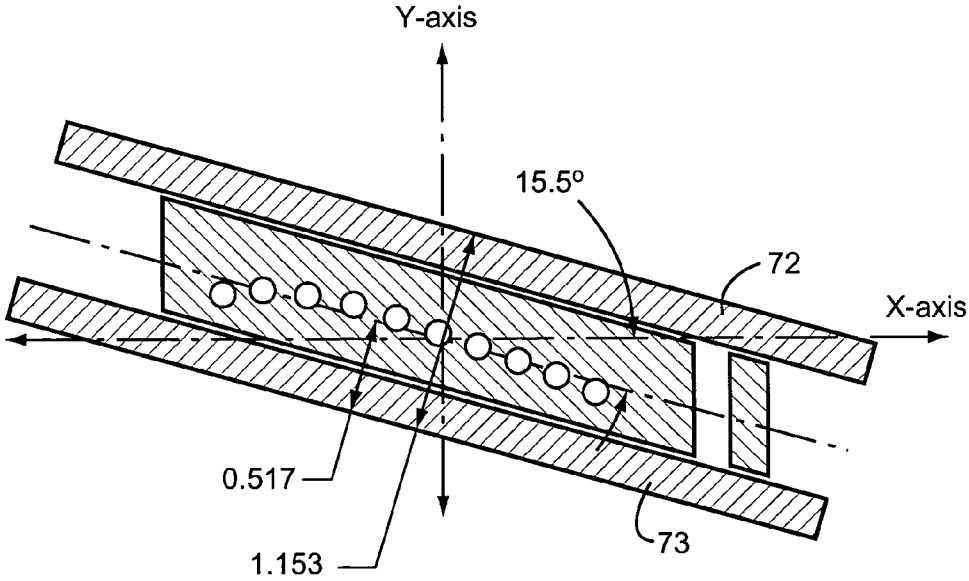
FIG. 8 is a schematic plan view generally taken about line 8—8 in FIG. 5, illustrating the rotation of the bucket shank relative to the X, Y and Z axes.

More specifically, the center point 63 of the cutter tooth 54, which is made up of two circumferentially (i.e., in the rotation direction) offset sections 62, 64, is located relative to the X and Y axes. Note in FIGS. 2 and 3 that the X-axis represents a flow direction of hot exhaust gases toward the turbine exhaust and is generally parallel to the rotor axis. The Y-axis represents a direction of rotation of the bucket 24 and hence of the rotor wheel 26. The location of the radial Z-axis extending perpendicular to the X-Y plane, is determined relative to predetermined reference surfaces in the shank 38 of the bucket. With specific reference to FIGS. 4 and 5, the Z-axis is located 1.866 inches from a forward edge 66 of the forward bucket tang 68, along the X-axis, and 0.517 inches from an outside edge of the seal pin 72 extending along said entry dovetail, as measured in a direction normal to the shank of the bucket. Note that the distance between the outside edges of the respective pins 72, 73 is 1.153 in. for pin diameters of 0.224 in. It should be noted that the shank portion of the bucket is rotated 15.5° in the clockwise direction about the Z-axis. Thus, the dimensions defining the location of the Z-axis as shown in FIG. 4 are better appreciated with reference to FIG. 8 which shows the true reference orientations for the measurements. The location of the Z-axis thus also defines the coordinates X=0, Y=0. The Z=0 point (FIG. 4) on the Z-axis is located 24.1 inches from the rotor centerline when the bucket is installed on the wheel.

Turning again to FIG. 6, the upstream (relative to the direction of rotation) edge 60 of the cutter tooth section 64 is located 0.550±0.25 inches, along the Y-axis, i.e., measured from the Z-X plane, in the direction of rotation of the airfoil.

The width of each tooth section 62, 64 at the radially outer tip thereof is about 0.25 in., plus or minus accepted machine tolerances, i.e. ±0.160 in. The upstream edge of the tooth section 62 lies substantially 0.376 inches±0.160 in. along the Y-axis, also in the direction of rotation of the bucket. Thus, the center 63 of the tooth per se is located 0.588 in. along the Y-axis at the X=0 position.

Figure 7:
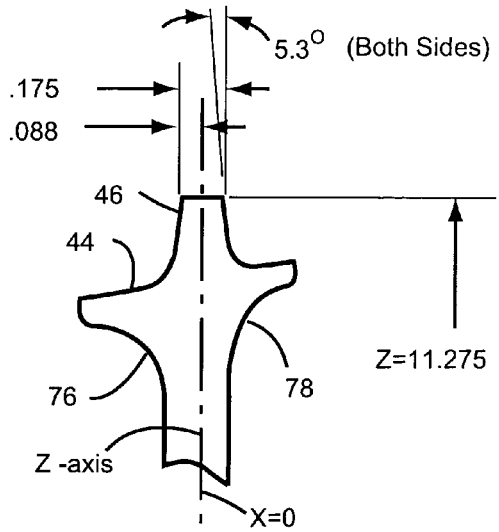
FIG. 7 is a cross-sectional view of the bucket taken through the cutter tooth generally taken about line 7—7 in FIG. 6.

FIG. 7 shows certain additional details of the tip shroud 44 and its relation to the Z-axis. In the exemplary embodiment, the radially outermost tip of the tip shroud seal 46 is located 11.275 inches from the Y=0, X=0 coordinates. On the leading side of the bucket, the forward edge of the tip seal 46 is located 0.88 in. from the Y-Z plane, while the width dimension of the seal 46 at its radial tip is 0.175 in. The sides of the tip seal 46 both taper inwardly in the radial outward direction by 5.3°.

By locating the center of tooth 54 as described herein, the stresses in the fillet below the tip shroud, indicated at 76, 78 in FIG. 7, are reduced and part lives increased. The analysis used to determine the optimum position for the cutter tooth is based on the geometry of the second stage bucket, the tip shroud, and the location of cooling holes in the tip shroud. The exact location of the cutter tooth will therefore vary for other bucket-shroud configurations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket comprising:

an airfoil having a tip shroud, a shank and an entry dovetail;

a tip shroud seal projecting radially outwardly from said tip shroud and extending continuously between end edges of the tip shroud in a direction of rotation of said airfoil about a turbine axis;

a cutter tooth carried by said tip shroud seal for enlarging a groove in an opposing fixed shroud, said cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein said center point is located about ½ inch along the Y-axis from the X=0 position, and wherein said Z-axis is located 0.517 inches from an outside edge of a seal pin extending along said entry dovetail, as measured in a direction normal to the shank of the bucket, and 1.866 inches from a forward edge of a forward tang on said turbine bucket entry dovetail, as measured along said X-axis.

2. A turbine bucket of claim 1 wherein said center point is located 0.588 in. along said Y-axis.

3. The turbine bucket of claim 2 wherein a Z-axis=0 position is established at a distance of 24.1 inches from longitudinal axis of rotation of a rotor on which the turbine bucket is adapted to be mounted, and wherein a radially outermost edge of said tip shroud seal is located 11.275 inches from said Z-axis=0 position.

4. A turbine bucket comprising:

an airfoil having a tip shroud, a shank and an entry dovetail;

a tip shroud seal projecting radially outwardly from said tip shroud;

a cutter tooth carried by said tip shroud seal for cutting a groove in a radially opposed fixed shroud;

said cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein said center point is located about ½ inch along said Y-axis, and wherein said Z-axis is located 1.866 inches from a forward edge of a forward tang on said turbine bucket entry dovetail, as measured along said X-axis, and 0.517 inches from an outside edge of a seal pin extending along said entry dovetail, as measured in a direction normal to the shank of the bucket, and further wherein said seal pin has a diameter of 0.224 in.

5. The turbine bucket of claim 4 wherein a Z-axis=0 position is established at a distance of 24.1 inches from said longitudinal axis of rotation of the rotor, and wherein a radially outermost edge of said tip shroud seal is located 11.275 inches from said Z-axis=0 position.

6. A turbine bucket comprising:

an airfoil having a tip shroud, a shank and an entry dovetail;

a tip shroud seal projecting radially outwardly from said tip shroud and extending continuously between end edges of said tip shroud in a direction of rotation of said airfoil about a turbine axis;

a cutter tooth formed by a pair of offset sections, each having a radially outer tip with a width of about 0.25 inch, said cutter tooth carried by said tip shroud seal for enlarging a groove in an opposing fixed shroud; said cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein said center point is located 0.588 in. along said Y-axis; and wherein said Z-axis is located 1.866 inches from a forward edge of a forward tang on said turbine bucket entry dovetail as measured along said X-axis, and 0.517 inches from an outside edge of a seal pin extending along said entry dovetail, as measured in a direction normal to the shank of the bucket.

7. The turbine bucket of claim 6 wherein a Z-axis=0 position is established at a distance of 24.1 inches from said longitudinal axis of rotation of the rotor, and wherein a radially outermost edge of said tip shroud seal is located 11.275 inches from said Z-axis=0 position.

8. A second stage turbine wheel for a gas turbine rotor, said wheel mounting a plurality of buckets, each bucket comprising:

an airfoil having a tip shroud, a shank and an entry dovetail;

a tip shroud seal projecting radially outwardly from said tip shroud and extending continuously between end edges of the tip shroud in a direction of rotation of said airfoil about a longitudinal axis of rotation of the rotor;

a cutter tooth carried by said tip shroud seal for enlarging a groove in an opposing fixed shroud, said cutter tooth having a center point located with reference to X, Y and Z axes, where the X-axis extends axially in an exhaust flow direction; the Y-axis extends in a direction of rotation of the turbine bucket; and the Z-axis extends radially through the intersection of the X and Y axes; wherein said center point is located about ½ inch along the Y-axis from the X=0 position and wherein said Z-axis is located 0.517 inches from an outside edge of a seal pin extending along said entry dovetail, as measured in a direction normal to the shank of the bucket, and 1.866 inches from a forward edge of a forward tang on said turbine bucket entry dovetail, as measured along said X-axis.

9. The second stage turbine wheel of claim 8 wherein said center point is located 0.588 in. along said Y-axis.

10. The second stage turbine wheel of claim 8 wherein a Z-axis=0 position is established at a distance of 24.1 inches from said longitudinal axis of rotation of the rotor, and wherein a radially outermost edge of said tip shroud seal is located 11.275 inches from said Z-axis=0 position.

* * * * *